US010476180B2

(12) United States Patent
Eckel et al.

(10) Patent No.: US 10,476,180 B2
(45) Date of Patent: Nov. 12, 2019

(54) CONNECTOR FOR THE CONNECTION OF TWO ELECTRICAL CONDUCTORS

(71) Applicant: TE Connectivity Germany GmbH, Bensheim (DE)

(72) Inventors: Markus Eckel, Burstadt (DE); Wilhelm Grzywok, Munich (DE); Uwe Hauck, Kleinmachnow (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/493,852

(22) Filed: Apr. 21, 2017

(65) Prior Publication Data

US 2017/0229789 A1 Aug. 10, 2017

Related U.S. Application Data

(63) Continuation of application No. PCT/EP2015/074297, filed on Oct. 21, 2015.

(30) Foreign Application Priority Data

Oct. 21, 2014 (DE) ..... 10 2014 221 347

(51) Int. Cl.
*H01R 13/44* (2006.01)
*H01R 4/36* (2006.01)
(Continued)

(52) U.S. Cl.
CPC ..... *H01R 4/363* (2013.01); *H01R 4/305* (2013.01); *H01R 13/44* (2013.01); *H01R 25/162* (2013.01); *H01R 4/20* (2013.01); *H01R 13/53* (2013.01)

(58) Field of Classification Search
CPC ..... H01R 2201/26; H01R 4/20; H01R 11/12; H01R 4/34; H01R 13/622; H01R 43/048;
(Continued)

(56) References Cited

U.S. PATENT DOCUMENTS 2,481,194 A 9/1949 Bubb et al.
3,864,005 A * 2/1975 Klein ..... H01R 4/363 439/812
(Continued)

FOREIGN PATENT DOCUMENTS

CN 102394394 A 3/2012
DE 1835062 U 7/1961
(Continued)

OTHER PUBLICATIONS

German Search Report, dated Sep. 28, 2015, 6 pages.
(Continued)

*Primary Examiner* — Truc T Nguyen
(74) *Attorney, Agent, or Firm* — Barley Snyder

(57) ABSTRACT

A connector comprises a pressing assembly and a contact prevention member. The pressing assembly has a first receptacle receiving a first conductor, a pressing member which can be activated from an exterior of the pressing assembly, and a chamber. The contact prevention member has a contacting slot open to an interior of the contact prevention member and a second receptacle receiving a second conductor. The contact prevention member is insertable into the chamber of the pressing assembly in an insertion direction.

20 Claims, 8 Drawing Sheets

(51) Int. Cl.

| | |
|---|---|
| ***H01R 4/30*** | (2006.01) |
| ***H01R 25/16*** | (2006.01) |
| *H01R 4/20* | (2006.01) |
| *H01R 13/53* | (2006.01) |

(58) Field of Classification Search
CPC ..... H01R 4/30; H01R 4/64; H01R 13/5216; H01R 43/005; H01R 43/052; H01R 43/20; H01R 4/185; H01R 4/305; H01R 11/26
See application file for complete search history.

(56) References Cited

U.S. PATENT DOCUMENTS

| | | | | |
|---|---|---|---|---|
| 4,059,335 | A * | 11/1977 | Simon | H01R 4/301 439/813 |
| 4,066,324 | A * | 1/1978 | Stephens | H01P 1/24 174/153 A |
| 4,103,986 | A * | 8/1978 | Izraeli | H01R 4/363 439/811 |
| 5,831,498 | A * | 11/1998 | Maloney | H01H 9/0264 335/8 |
| 5,879,198 | A * | 3/1999 | Sekimori | H01R 13/44 439/289 |
| 5,934,818 | A * | 8/1999 | Schmitt | H01R 4/4872 403/396 |
| 6,529,112 | B1 * | 3/2003 | Leone | H01R 4/36 337/113 |
| 7,578,711 | B2 * | 8/2009 | Robinson | H01H 71/08 335/202 |
| 7,780,488 | B2 * | 8/2010 | Robertson | H01R 35/00 439/777 |
| 7,798,869 | B1 * | 9/2010 | Konopacki | H01R 4/363 439/812 |
| 8,870,609 | B2 | 10/2014 | Eberts et al. | |
| 2006/0155280 | A1 * | 7/2006 | Siebens | H01R 4/36 439/781 |
| 2009/0191771 | A1 * | 7/2009 | Watanabe | H01R 4/183 439/877 |
| 2010/0075546 | A1 * | 3/2010 | Rico | H01R 4/36 439/814 |
| 2010/0120300 | A1 * | 5/2010 | Battle | H01R 4/2408 439/798 |
| 2013/0252486 | A1 * | 9/2013 | Kosyanchuk | H01R 4/304 439/813 |
| 2014/0110230 | A1 | 4/2014 | Eberts et al. | |
| 2014/0113507 | A1 * | 4/2014 | Vanzetto | H01R 4/366 439/812 |
| 2015/0180139 | A1 * | 6/2015 | Alvarez Vazquez | H01R 4/305 439/793 |

FOREIGN PATENT DOCUMENTS

| | | | |
|---|---|---|---|
| DE | 3514097 | A1 | 10/1986 |
| DE | 19728716 | C1 | 11/1998 |
| DE | 102007039985 | B3 | 12/2008 |
| DE | 102009017817 | A1 | 10/2010 |
| DE | 102010021736 | A1 | 11/2011 |
| FR | 2455371 | | 11/1980 |
| FR | 2795560 | A1 | 12/2000 |
| GB | 2312564 | A | 10/1997 |
| JP | S55-155023 | Y | 4/1954 |
| JP | H08175231 | A | 7/1996 |
| JP | H09-274947 | A | 10/1997 |
| JP | H10-199591 | A | 7/1998 |
| JP | 2012001096 | A | 1/2012 |

OTHER PUBLICATIONS

PCT Search Report, dated Jan. 15, 2016, 9 pages.
Abstract of JPH09-274947A, dated Oct. 21, 1997, 1 page.
Abstract of JPH10-199591A, dated Jul. 31, 1998, 1 page.
Japanese Notification of Reasons for Refusal and English translation, dated Mar. 29, 2018, 10 pages.
Japanese Notice of Reasons for Refusal with English translation, dated Sep. 18, 2018, 6 pages.
Chinese First Office Action with English translation, dated Sep. 5, 2018, 20 pages.
Abstract of CN 102394394 A, dated Mar. 28, 2012, 1 page.
Chinese Second Office Action with English translation, Chinese Patent Application No. 201580057536X, dated Apr. 4, 2019, 21 pages.
Abstract of JPH08175231A, dated Jul. 9, 1996, 1 page.

* cited by examiner

CONNECTOR FOR THE CONNECTION OF TWO ELECTRICAL CONDUCTORS

CROSS-REFERENCE TO RELATED APPLICATIONS

This application is a continuation of PCT International Application No. PCT/EP2015/074297, filed on Oct. 21, 2015, which claims priority under 35 U.S.C. § 119 to German Patent Application No. 102014221347.9, filed on Oct. 21, 2014.

FIELD OF THE INVENTION

The present invention relates to a connector and, more particularly, to a connector for the connection of two electrical conductors.

BACKGROUND

Connectors for connecting electrical conductors are known. Two conductors are often connected to one another by plugging together. In the high voltage and/or high current range, however, plug connections are often impractical since solid conductors are frequently used; the only known plug connectors are inadequate for solid conductors. Screw connections are used for connecting at least one conductor rail or cable lug to a different conductor. For example, a cable lug with an opening for a screw can be screwed to a conductor rail or a second cable lug. In this case, either a screw projects through the cable lug and is screwed to a pressing nut in the conductor rail, or the screw projects through both parts and is provided with a nut so that the conductor rail and the cable lug are clamped between screw head and nut. Similar connections are used if two conductor rails or two cable lugs are to be connected to one another.

Known screw connections for conductors are complex and have a number of disadvantages. For example, screws and/or nuts can get lost during connection or detachment of the conductors. A screw also might not be able to be fully unscrewed from both conductors; once the screw arrives at the end of maximum travel, it may fully penetrate through one of the two conductors and at the same time be still partially arranged in the other conductor. This makes it more difficult or even impossible to detach the two conductors from one another. A further known disadvantage is that at least one of the two conductors is often only protected insufficiently or not at all from contact and can therefore endanger the safety of a person handling at least one of the conductors.

SUMMARY

An object of the invention, among others, is to provide a connector for connecting two electrical conductors by which the two conductors can be repeatedly connected to and detached from one another with increased safety. A connector according to the invention comprises a pressing assembly and a contact prevention member. The pressing assembly has a first receptacle receiving a first conductor, a pressing member which can be activated from an exterior of the pressing assembly, and a chamber. The contact prevention member has a contacting slot open to an interior of the contact prevention member and a second receptacle receiving a second conductor. The contact prevention member is insertable into the chamber of the pressing assembly in an insertion direction.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
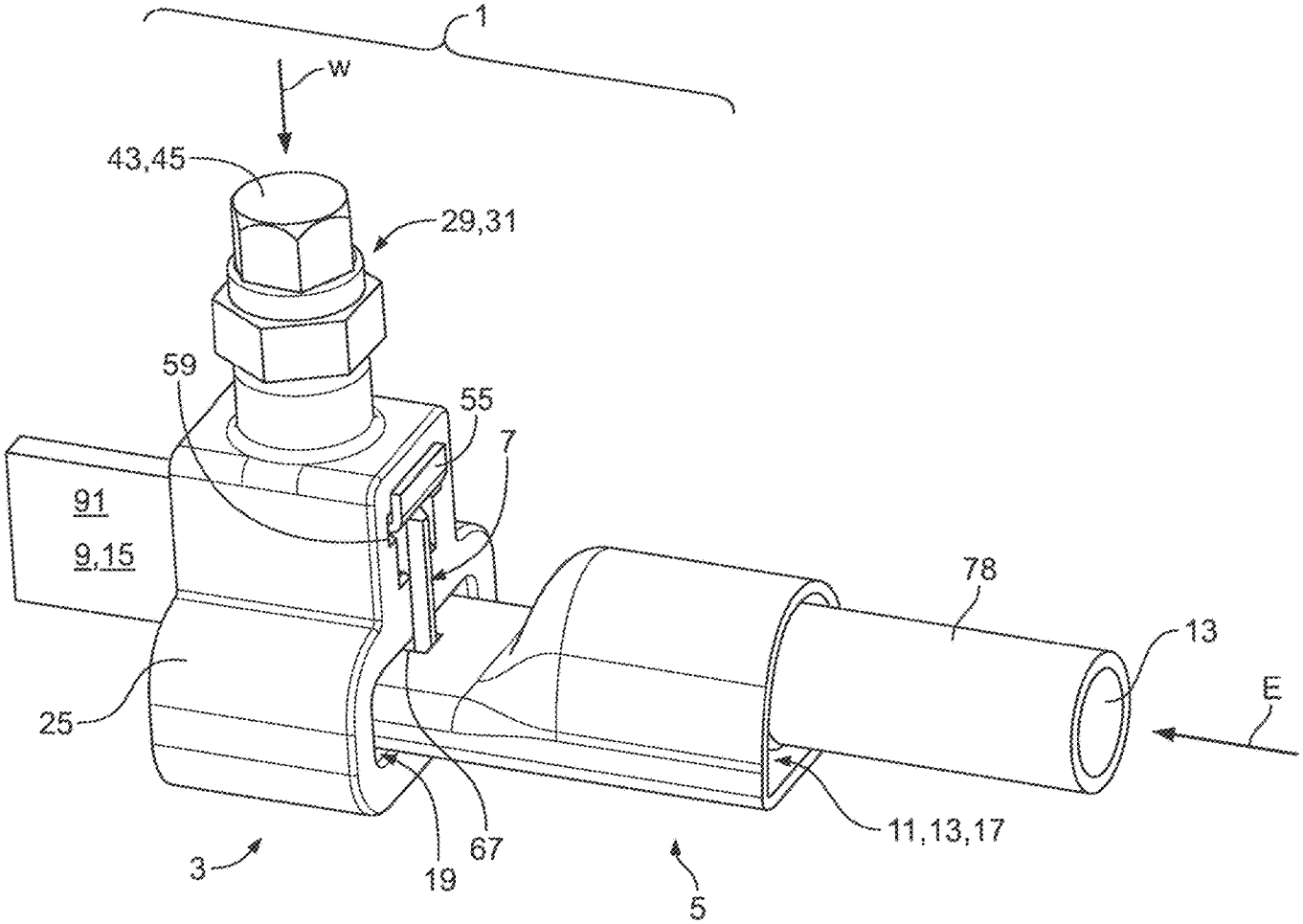
FIG. 1 is a perspective view of a connector according to a first embodiment of the invention without a housing.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the present disclosure will be thorough and complete, and will fully convey the concept of the disclosure to those skilled in the art.

A connector 1 according to an embodiment of the invention is shown in FIGS. 1-5. The connector 1, as shown in FIG. 1, includes a pressing assembly 3 and a contact prevention member 5. The connector 1 is used to electrically connect a first conductor 9 to a second conductor 13. In the shown embodiment, the first conductor 9 is a conductor rail 15 and the second conductor 13 is a cable lug 17. Alternatively, it is possible for the first conductor 9 to be formed by a cable lug 17 and the second conductor 13 by a conductor rail 15. It is also possible that both conductors 9 and 13 are formed by conductor rails 15 or cable lugs 17.

As shown in FIG. 1, the pressing assembly 3 has a receptacle 7 for the first conductor 9 and the contact prevention member 5 has a receptacle 11 for the second conductor 13. The pressing assembly 3 has a chamber 19 into which contact prevention member 5 can be inserted in insertion direction E. Chamber 19 is opened towards receptacle 7 for first conductor 9 so that first conductor 9 can project at least partially into chamber 19.

Figure 2:
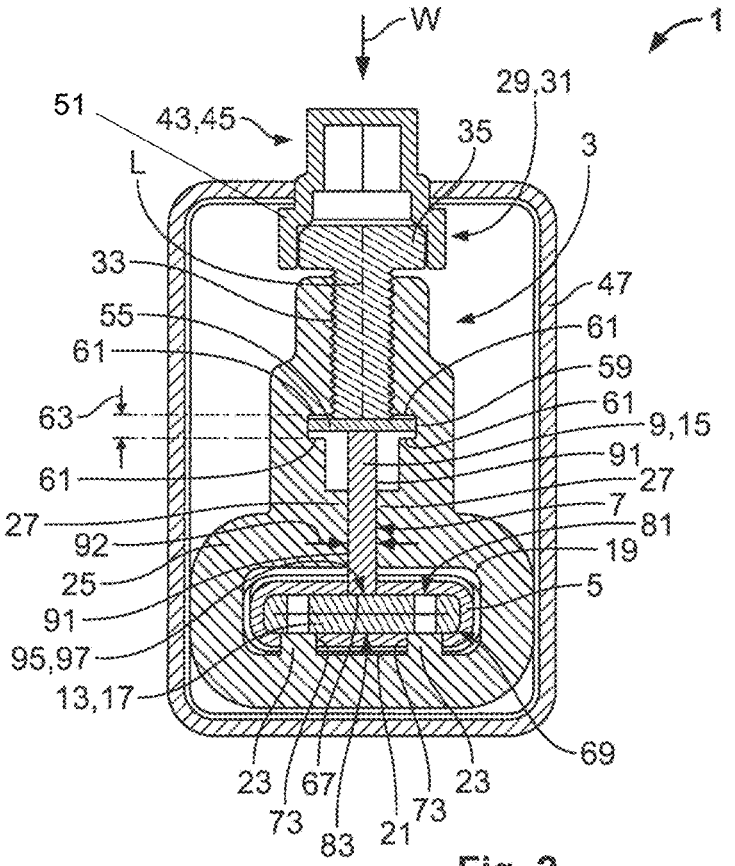
FIG. 2 is a sectional view of the connector of FIG. 1 with the housing.

At side 21 of the pressing assembly 3 which is opposite receptacle 7, shown in FIG. 2, pressing assembly 3 has two supporting ribs 23 which project into chamber 19. Supporting ribs 23 are elongated and extend parallel to insertion direction E. The supporting ribs 23 are formed monolithically with a body 25 of pressing assembly 3. In the shown embodiment, body 25 of pressing assembly 3 is formed by injection molding from a conductive material.

The receptacle 7 for first conductor 9 is delimited by two retaining jaws 27, shown in FIG. 2, which can be formed monolithically with body 25. Retaining jaws 27 guide first conductor 9 during insertion into pressing assembly 3 and retain it in a desired position. Retaining jaws 27 delimit chamber 19 for contact prevention member 5 in the direction of receptacle 7. Chamber 19 and receptacle 7 have substantially elongated forms in directions transverse to insertion direction E and are arranged perpendicular to one another. Chamber 19 is opened centrally at a height between two supporting ribs 23 towards receptacle 7. The elongated shape of receptacle 7 extends parallel to an effective direction W of pressing member 29, shown in FIGS. 1 and 2.

Figure 3:
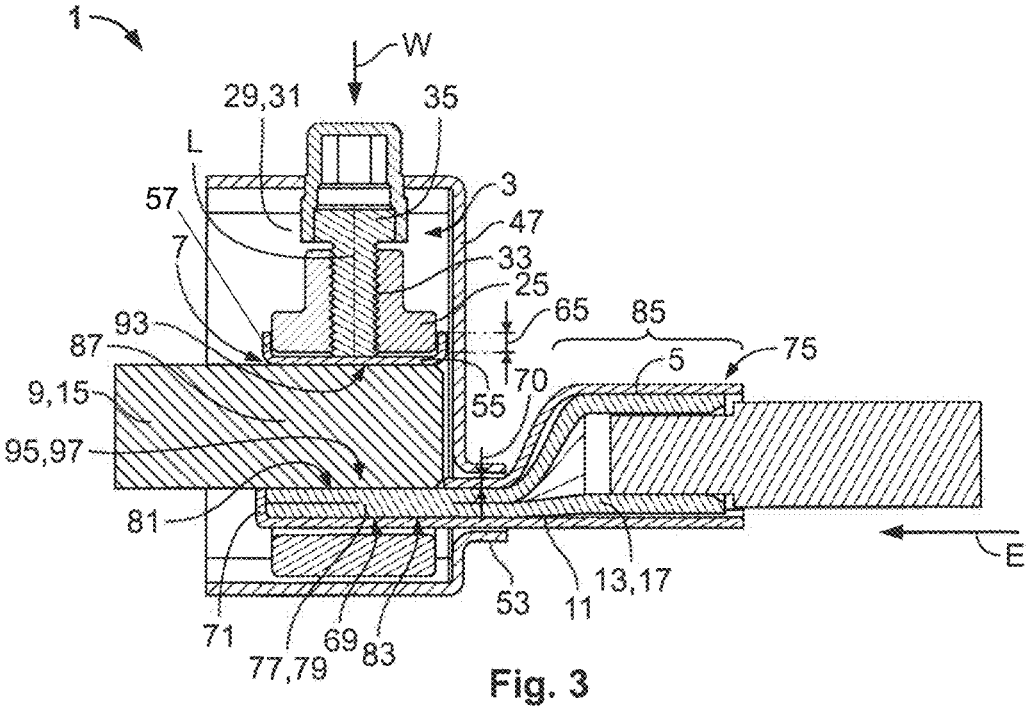
FIG. 3 is another sectional view of the connector of FIG. 1 with the housing.

Pressing member 29, as shown in FIGS. 1-3, connects first conductor 9 in a frictionally engaged manner to second conductor 13. In the shown embodiment, the pressing member 29 is a screw 31. Screw 31 is guided by an internal thread 33 in body 25 of pressing assembly 3. In other embodiments, pressing assembly 3 can also have a nut connected to body 25 for guidance of screw 31. Rotating screw 31 about screw longitudinal axis L results in a movement of screw 31 along or counter to effective direction W. Screw 31 has a screw head 35, which points counter to effective direction W, usable as an activation portion 41. Screw head 35 has a screw head diameter 37 which is larger than a screw diameter 39; as a result, screw 31 cannot be fully countersunk in internal thread 33. Body 25 forms a stop for screw head 35 in effective direction W. The activation portion 41 need not necessarily be shaped as the screw head 35; if screw 31 is embodied, for example, as a grub screw, activation portion 41 can be shaped at the end of screw 31 pointing counter to effective direction W without exceeding screw diameter 39. In another embodiment, activation portion 41 can be formed as a hexagonal socket.

The pressing member 29, as shown in FIG. 2, has an electrically insulated activation portion 43 formed by an insulating cap 45. Insulating cap 45 can have the form of a screw head in order to be activated by a correspondingly configured tool. In the shown embodiment, insulating cap 45 is made from a plastic. The insulating cap 45 insulates the pressing member 29 to the outside of the pressing assembly 3.

Connector 1, as shown in FIGS. 2-5, includes a housing 47 insulated from the pressing assembly 3. Housing 47 has an opening 49 through which electrically insulated activation portion 43 of pressing member 29 projects to the outside. Opening 49 is smaller than a stop element 51 of electrically insulated activation portion 43. Stop element 51 is a circumferential ring or a screw head which stops electrically insulated activation portion 43 counter to effective direction W. Stop element 51 prevents pressing member 29 from being removed completely from pressing assembly 3.

Figure 4:
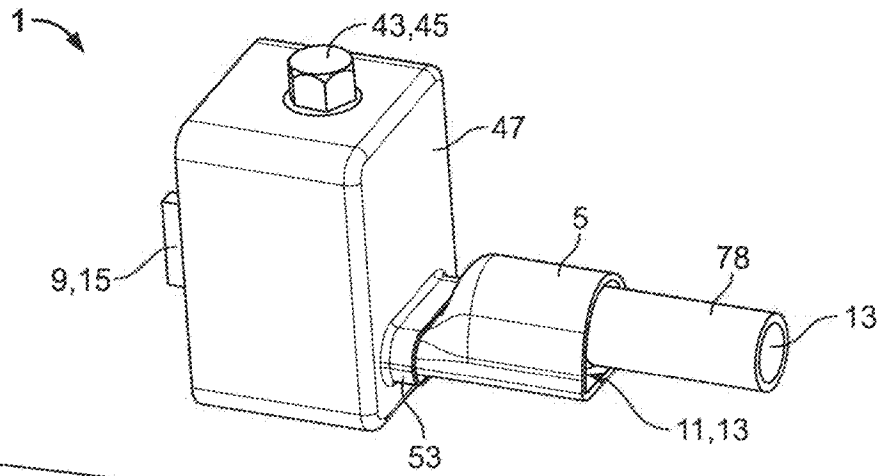
FIG. 4 is a perspective view of the connector of FIG. 1 with the housing.
Figure 5:
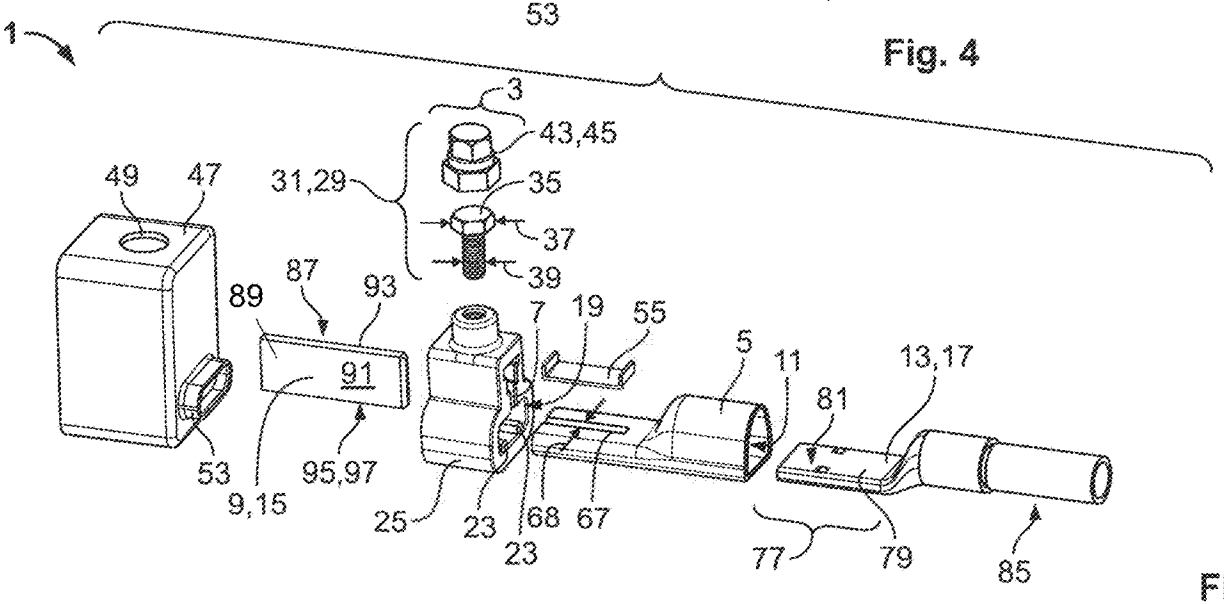
FIG. 5 is an exploded perspective view of the connector of FIG. 1 with the housing.

Housing 47 has a collar 53, as shown in FIGS. 4 and 5, which projects counter to insertion direction E and which opens into chamber 19 for receiving contact prevention member 5. Collar 53 can prevent a finger, a tool or another part from entering housing 47 and being able to establish electrical contact with one of the elements located in housing 47.

A movable force-distribution member 55, as shown in FIGS. 1-3, is arranged between pressing member 29 and receptacle 7 for first conductor 9. Force-distribution member 55 distributes a force generated by pressing member 29 in effective direction W to the first conductor 9 arranged in receptacle 7. Force-distribution member 55 is at least as long in insertion direction E as body 25 of pressing assembly 3. In a direction transverse to insertion direction E and transverse to effective direction W, the force-distribution member 55 is wider than screw diameter 39 and wider than receptacle 7 for first conductor 9. Force-distribution member 55 projects, in and counter to insertion direction E, out of body 25 of pressing assembly 3, as shown in FIGS. 1 and 3. Ends 57 of the force-distribution member 55 are bent upwards counter to effective direction W so that force-distribution member 55 partially engages around body 25. As a result, force-distribution member 55 is secured against a displacement in insertion direction E.

A receptacle 59 is provided in pressing assembly 3 for receiving force-distribution member 55, as shown in FIGS. 1 and 2. The receptacle 59 has impact faces 61 which secure force-distribution member 55 against a movement parallel to effective direction W. A spacing 63 between impact faces 61 in the direction of effective direction W is smaller than a length 65 of bent over ends 57 parallel to effective direction W. As a result, force-distribution member 55 is retained in a positively engaged manner in receptacle 59.

Contact prevention member 5, as shown in FIGS. 1-3 and 5, has a contacting slot 67 which extends parallel to insertion direction E. Contacting slot 67 is arranged centrally on contact prevention member 5 in the cross-section transverse to insertion direction E. Contacting slot 67 opens into an interior 69 of contact prevention member 5. Contacting slot 67 extends as far as a front end 71 of contact prevention member 5. Contacting slot 67 has a slot width 68 transverse to insertion direction E. The slot width 68 may be approximately 2-4 mm, for example, 3.5 mm. A wall thickness 70 of contact prevention member 5 in the region of contacting slot 67 is selected so that a ratio of slot width 68 to wall thickness 70 is approximately 1.75; the wall thickness 70 may be approximately 1.5-2.5 mm. Contact prevention member 5 is closed at front end 71.

When contact prevention member 5 is received in the chamber 19, as shown in FIGS. 1 and 2, contacting slot 67 is open from the interior 69 of contact prevention member 5 towards receptacle 7 for the first conductor 9. In this case, pressing member 29 is arranged above contacting slot 67. In the direction transverse to the insertion direction E, longitudinal axis L, running parallel to effective direction W, of pressing member 29 is arranged centrally above contacting slot 67.

Contact prevention member 5, as shown in FIG. 2, includes supporting slots 73 on a side opposite contacting slot 67. Supporting slots 73 are complementary to supporting ribs 23 of pressing assembly 3. As a result of the interaction between supporting slots 73 and supporting ribs 23, contact prevention member 5 is guided as it is inserted into chamber 19. At a rear end 75, as shown in FIG. 3, contact prevention member 5 extends far enough for electrically conductive parts of second conductor 13 to be fully covered. An insulation 78 of second conductor 13 projects into contact prevention member 5.

End portion 77 of second conductor 13, as shown in FIG. 3, is formed by flat body 79 of cable lug 17. Flat body 79 has an upper flat side 81 and a lower flat side 83. Upper flat side 81 communicates with contacting slot 67 for making contact with first conductor 9. Lower flat side 83 is open through supporting slots 73 towards supporting ribs 23. Flat sides 81 and 83 extend perpendicular to effective direction W when second conductor 13 with contact prevention member 5 is received in chamber 19.

Cable lug 17, as shown in FIG. 3, has a crimp region 85 behind the flat body 79. In crimp region 85, cable lug 17 is surrounded by contact prevention member 5. Second conductor 13 is therefore protected by contact prevention member 5 and cable insulation 78 to prevent contact.

The first conductor 9 has, at least in its end portion 87 which can be received in receptacle 7, a conductor rail 15, as shown in FIGS. 1, 3, and 5. As described above, first conductor 9 can have a cable lug, the end portion of which, instead of the conductor rail, is received in receptacle 7. End portion 87 of first conductor 9 is formed as flat body 89. Flat sides 91 of first conductor 9 run parallel to effective direction W and parallel to insertion direction E when first conductor 9 is received in receptacle 7 in pressing assembly 3. Flat sides 91 of the first conductor therefore run perpendicular to flat sides 81 and 83 of second conductor 13 when both conductors are arranged in pressing assembly 3. Flat sides 91 have a spacing 92 which corresponds at least to slot width 68 of contacting slot 67.

Flat body 89 of first conductor 9 has an upper edge 93 and a lower edge 95 which run parallel to the insertion direction and form narrow sides of flat body 89, as shown in FIG. 5. Lower edge 95 forms contacting element 97 of first conductor 9. Since contacting element 97 is formed by lower edge 95 of end portion 87, or flat body 89, contacting element 97 is formed monolithically with first conductor 9.

For first conductor 9 to make contact with second conductor 13, first conductor 9 is pressed against second conductor 13. For connecting the two conductors 9 and 13, pressing member 29 is activated so that at least one of the two conductors 9 and 13 or both can be smoothly inserted into the respective receptacle. Only once both first conductor 9 and second conductor 13 are arranged with contact prevention member 5 in the respective receptacles or chamber 19 is pressing member 29 activated so that a force is exerted in effective direction W on both conductors 9 and 13.

Pressing member 29 exerts a normal force acting in effective direction W on end portion 87 of first conductor 9, as shown in FIGS. 2 and 3. The force is distributed uniformly by force-distribution member 55 over upper edge 93 of end portion 87. Lower edge 95 of end portion 81, which forms contacting element 97, projects through contacting slot 67 of contact prevention member 5 and is pressed against end portion 77 of second conductor 13. The pressure exerted by pressing member 29 therefore ensures a frictionally engaged connection between first conductor 9 and second conductor 13 in the region of contacting slot 67.

End portion 77 of second conductor 13 is pressed by pressure exerted by pressing member 29 against supporting ribs 23. Second conductor 13 is therefore pressed in between first conductor 9 and supporting ribs 23, and first conductor 9 is pressed in between force-distribution member 55 and second conductor 13. In addition to the electrical connection between first conductor 9 and second conductor 13 in the region of contacting slot 67, an indirect electrical connection can therefore be established via supporting ribs 23 with end portion 77 of second conductor 13. Body 25 of pressing assembly 3 establishes an electrical connection with first conductor 9. This additional electrical connection can be transmitted, for example, via retaining jaws 27 and/or via pressing member 29 and/or force-distribution member 55 to first conductor 9.

A connector 1' according to another embodiment of the invention is shown in FIGS. 6-9. For the sake of brevity, only the differences from the first embodiment shown in FIGS. 1-5 are described in detail.

Figure 6:
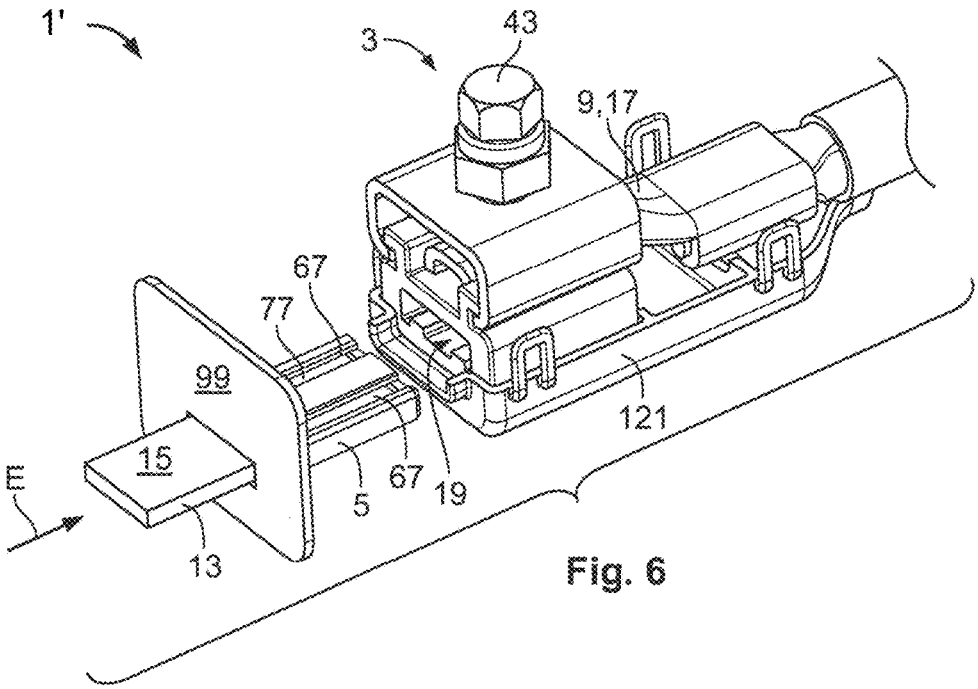
FIG. 6 is a perspective view of a connector according to a second embodiment of the invention.
Figure 7:
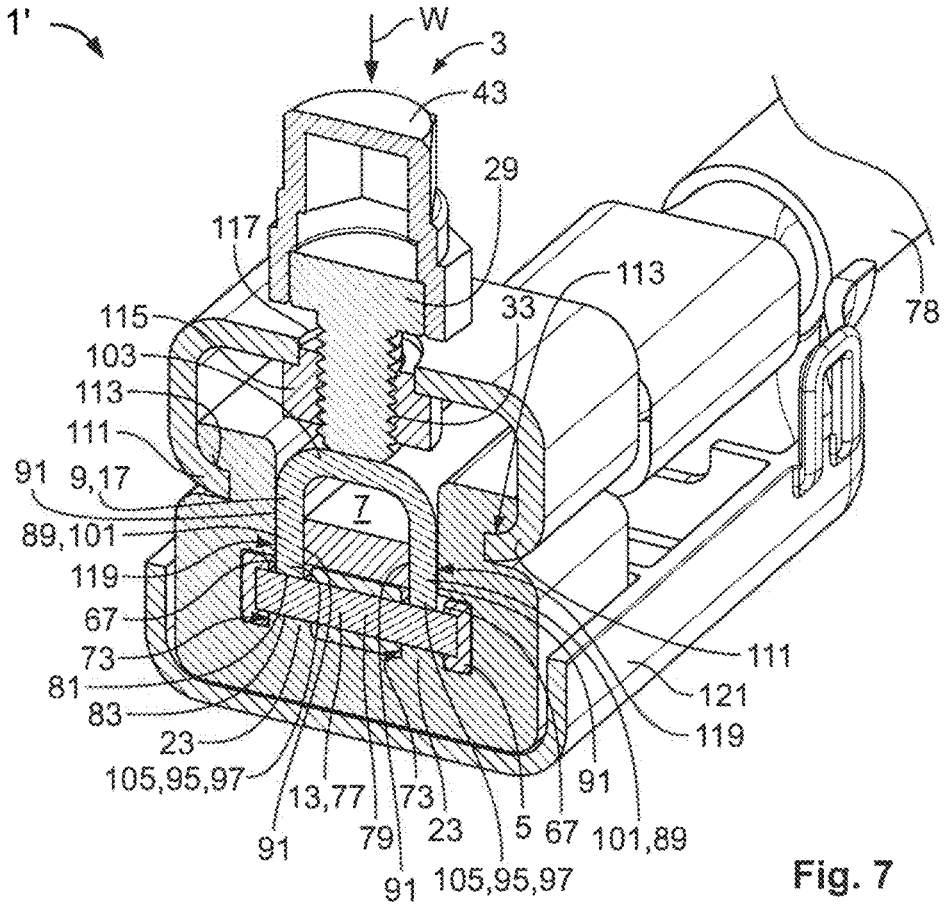
FIG. 7 is a sectional perspective view of the connector of FIG. 6.
Figure 8:
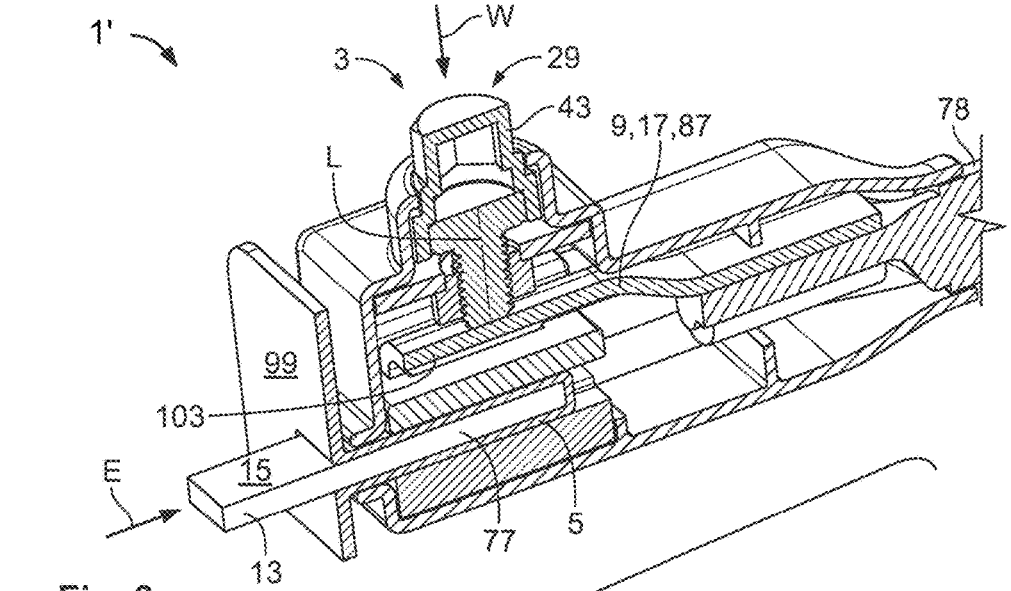
FIG. 8 is another sectional perspective view of the connector of FIG. 6.

Connector 1' has a contact prevention member 5 in which end portion 77 of second conductor 13 is arranged, as shown in FIGS. 6 and 7. In contrast to the first embodiment, second conductor 13 is formed by a conductor rail 15 in the second embodiment. The second conductor 13 may alternatively be a cable lug. The contact prevention member 5 has two contacting slots 67 which are arranged next to one another and parallel to one another and parallel to insertion direction E. Contacting slots 67 lie opposite supporting slots 73. Contact prevention member 5 can be formed as part of a housing of which a housing wall portion 99 is shown in FIG. 6. Housing wall portion 99 extends perpendicular to insertion direction E.

As in the first embodiment, pressing assembly 3 of the second embodiment has a chamber 19 into which contact prevention member 5 can be inserted in insertion direction E.

First conductor 9 is formed as a cable lug 17. If second conductor 13 is also formed as a cable lug, connector 1' connects two cable lugs to one another. The first conductor 9 can alternatively be formed by a conductor rail. The second conductor can then also be either a cable lug or a conductor rail.

Figure 9:
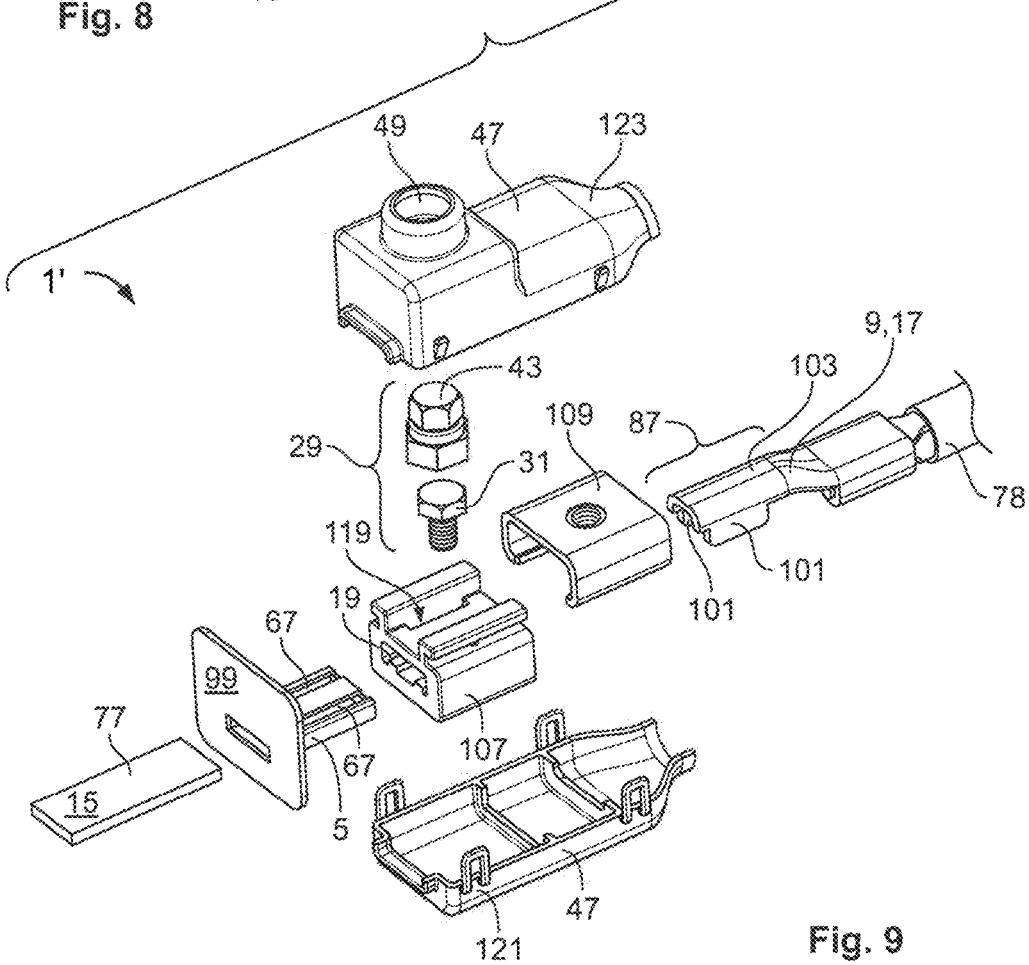
FIG. 9 is an exploded perspective view of the connector of FIG. 6.
Figure 10:
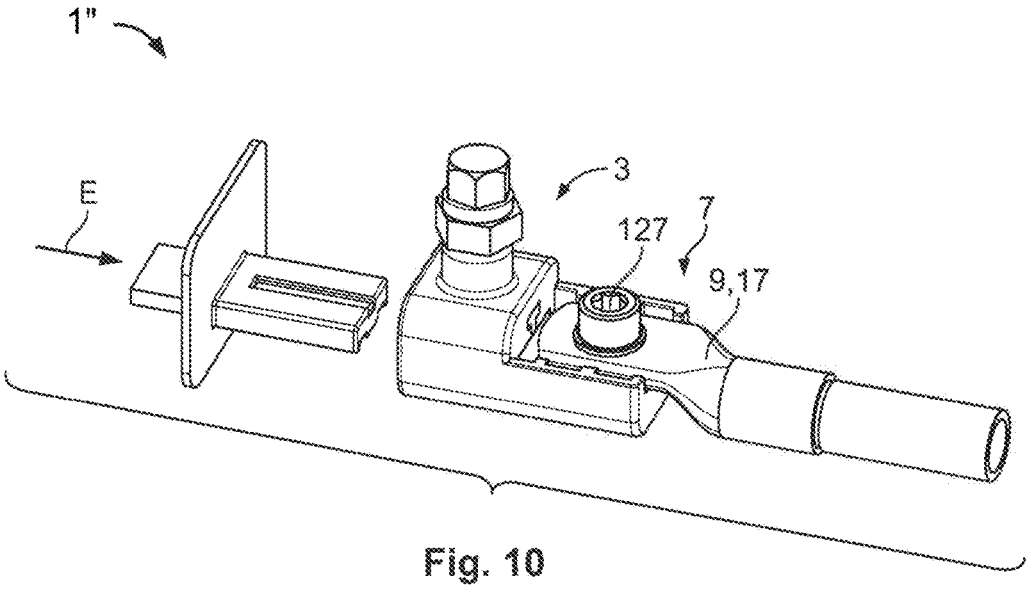
FIG. 10 is a perspective view of a connector according to a third embodiment of the invention.
Figure 11:
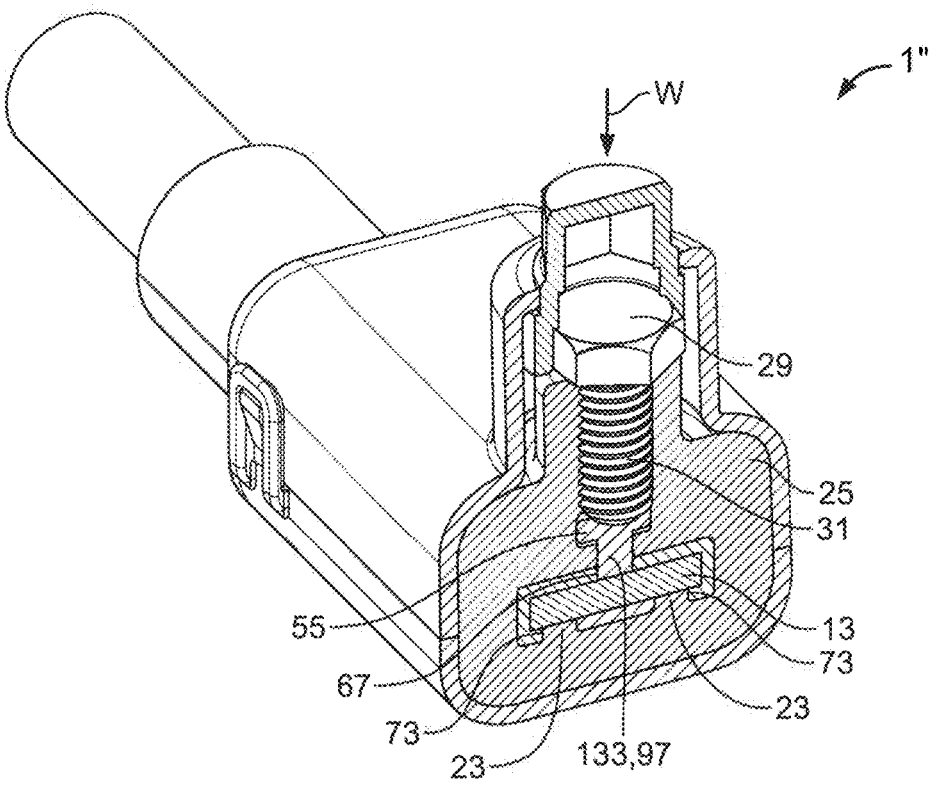
FIG. 11 is a sectional perspective view of the connector of FIG. 10.

End portion 87 of first conductor 9 has a U-shaped profile in a direction transverse to insertion direction E, as shown in FIGS. 7 and 9. The two limbs 101 of the U-shaped profile form two flat bodies 89 of first conductor 9, with flat sides 91 which are arranged perpendicular to flat sides 81 and 83 of flat body 79 of second conductor 13. Flat bodies 89 extend parallel to effective direction W and to insertion direction E. A transverse limb 103 of the U-shaped profile forms a flat body which extends, at least in certain regions, perpendicular to effective direction W and parallel to insertion direction E.

Pressing member 29 acts on transverse limb 103 as shown in FIG. 7. Transverse limb 103 distributes the force generated by pressing member 29 in effective direction W over the two limbs 101. Limbs 101 and transverse limb 103 are formed, by stamping and bending or by another shaping technique, from a previously flat cable lug 17. If first conductor 9 is formed by a conductor rail 15, conductor rail 15 can also be shaped by suitable shaping techniques so that two limbs 101 and one transverse limb 103 are produced.

At free limb ends 105, as shown in FIG. 7, first conductor 9 has lower edges 95 running parallel to insertion direction E. Said lower edges 95 form two contacting elements 97. Contacting elements 97 contact second conductor 13 by projecting through contacting slots 67. When contact is made, limb ends 105 lie opposite supporting ribs 23 parallel to effective direction W. As a result, second conductor 13 is particularly well supported and a frictional connection is established between first conductor 9 and second conductor 13.

As shown in FIGS. 7 and 9, body 25 is divided in two and has a lower contact portion 107 and an upper pressing portion 109. Alternatively to this, body 25 can also comprise a single part. Pressing portion 109 has a substantially U-shaped cross-section transverse to insertion direction E, wherein end portions 111 of the limbs of the U-shaped cross-section are bent towards one another. Contact portion 107 has two opposite grooves 113 open parallel to insertion direction E and on both sides transverse to effective direction W, into which grooves 113 limb ends 111 of the pressing portion 109 are received. Contact portion 107 and pressing portion 109 can be joined together by being inserted together in insertion direction E. If both parts are inserted together, the parts are retained against one another in a positively engaged manner in effective direction W.

Pressing portion 109 has an internal thread 33 for pressing member 29, which is formed as screw 31, as shown in FIG. 7. Internal thread 33 is part of a pressing nut 115 which is arranged in a complementary opening 117 in pressing portion 109. Alternatively to this, internal thread 33 can also be formed directly in pressing portion 109.

Contact portion 107 as shown in FIG. 7 has two contacting shafts 119 which open between the receptacle 7 for first conductor 9 and chamber 19. Contacting shafts 119 make it possible for limbs 101 of first conductor 9 to contact second conductor 13. In a connected state, limbs 101 project through contacting shafts 119 and contacting slots 67 as far as second conductor 13. Contacting shafts 119 are closed in insertion direction E and counter to insertion direction E. When limbs 101 of first conductor 9 are arranged in contacting shafts 119, limbs 101 are retained in a positively engaged manner in insertion direction E in contacting shafts 119. As a result, conductor 9 can be secured against being pulled out counter to insertion direction E.

Connector 1' has a housing 47, as shown in FIG. 9, which electrically insulates pressing assembly 3 and first conductor 9, located in pressing assembly 3, towards the outside. Housing 47 extends far enough in insertion direction E to cover a cable insulation 78 of first conductor 9. A collar 53 projects counter to insertion direction E and opens the way in chamber 19 for inserting in contact prevention member 5 and second conductor 13. An opening 49 in the housing makes it possible for an electrically insulated activation portion 43 of the pressing element to be activated from outside the housing. Opening 49, as in the case of the first embodiment, is configured so that electrically insulated activation portion 43 cannot penetrate fully through opening 49 to the outside, as a result of which pressing member 29 is retained captively on pressing assembly 3. Housing 47 can be formed in two parts with a lower shell 121 and an upper shell 123 which can be clipped together.

A connector 1" according to another embodiment of the invention is shown in FIGS. 10-13. Only differences from the embodiments in FIGS. 1-5 and 6-9 will be described in detail.

The connector 1" indirectly connects the first conductor 9 with second conductor 13. In the shown embodiment, the first conductor 9 is represented as cable lug 17 and the second conductor 13 is a conductor rail 15. First conductor 9 is retained in a receptacle 7 which is arranged in insertion direction E behind chamber 19 for contact prevention member 5.

Figure 13:
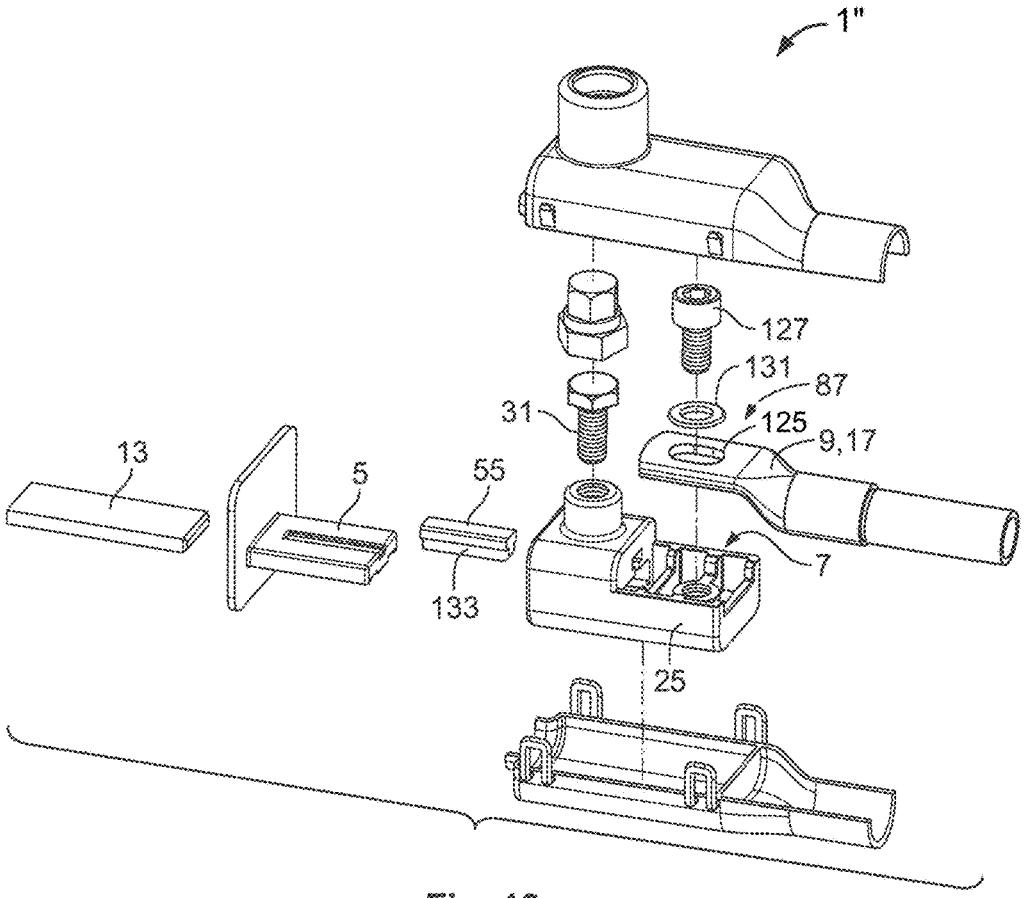
FIG. 13 is an exploded perspective view of the connector of FIG. 10.

First conductor 9 is screwed to body 25 of pressing assembly 3. First conductor 9 has in its end portion 87 an opening 125, as shown in FIG. 13. A screw 127 projects through opening 125, the screw 127 screwed into a thread 129 in body 25. Moreover, a flat washer 131 is disposed between screw 127 and first conductor 9. Body 25 is formed from an electrically conductive material so that body 25 becomes a part of conductor 9.

Figure 12:
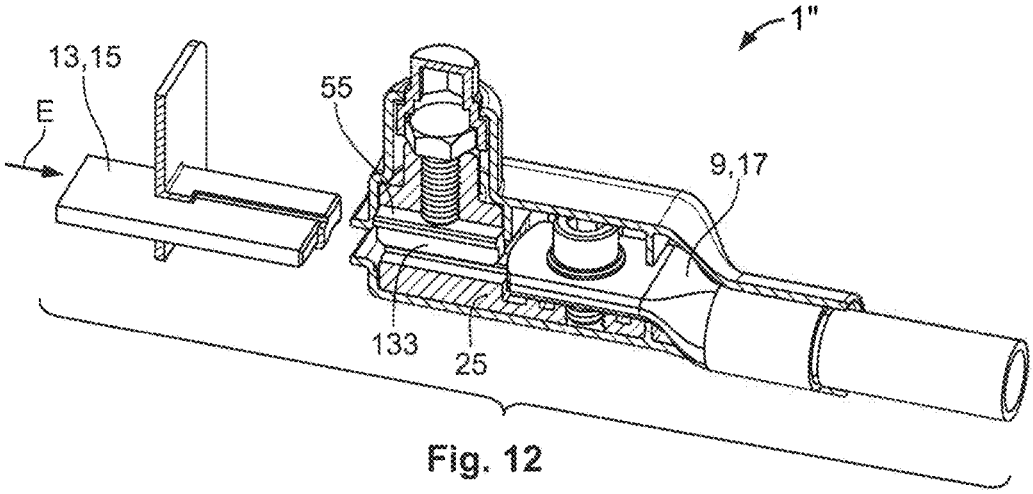
FIG. 12 is another sectional perspective view of the connector of FIG. 10.

Pressing assembly 3 has a force-distribution member 55, as shown in FIGS. 12 and 13, which is acted upon with pressure by pressing member 29 in effective direction W. Force-distribution member 55 has a contacting rib 133 which runs parallel to insertion direction E and projects in effective direction W. Contacting rib 133 is arranged above contacting slot 67, shown in FIG. 11, and is pressed by pressing member 29 through contacting slot 67 onto second conductor 13. Contacting rib 133 then represents a contacting element 97. Contacting rib 133 can be connected in an electrically conductive manner to body 25 via screw 31 and therefore establish an electrical contact between first conductor 9 and second conductor 13. During contact, second conductor 13 is pressed in the region of supporting slots 73 onto supporting ribs 23, which are formed monolithically with body 25. As a result, an electrical contact is additionally produced between first conductor 9 and second conductor 13 via supporting ribs 23.

As a result of screwing first conductor 9 to body 25, first conductor 9 can have any desired form. In addition to the stated forms as cable lug 17 or conductor rail 15, first conductor 9 can also be a cable which is pressed via the flat washer 131 onto body 25. Flat washer 131 can have, for example, the form of a bracket so that a multi-element cable can also be pressed by screw 127 onto body 25.

Figure 14:
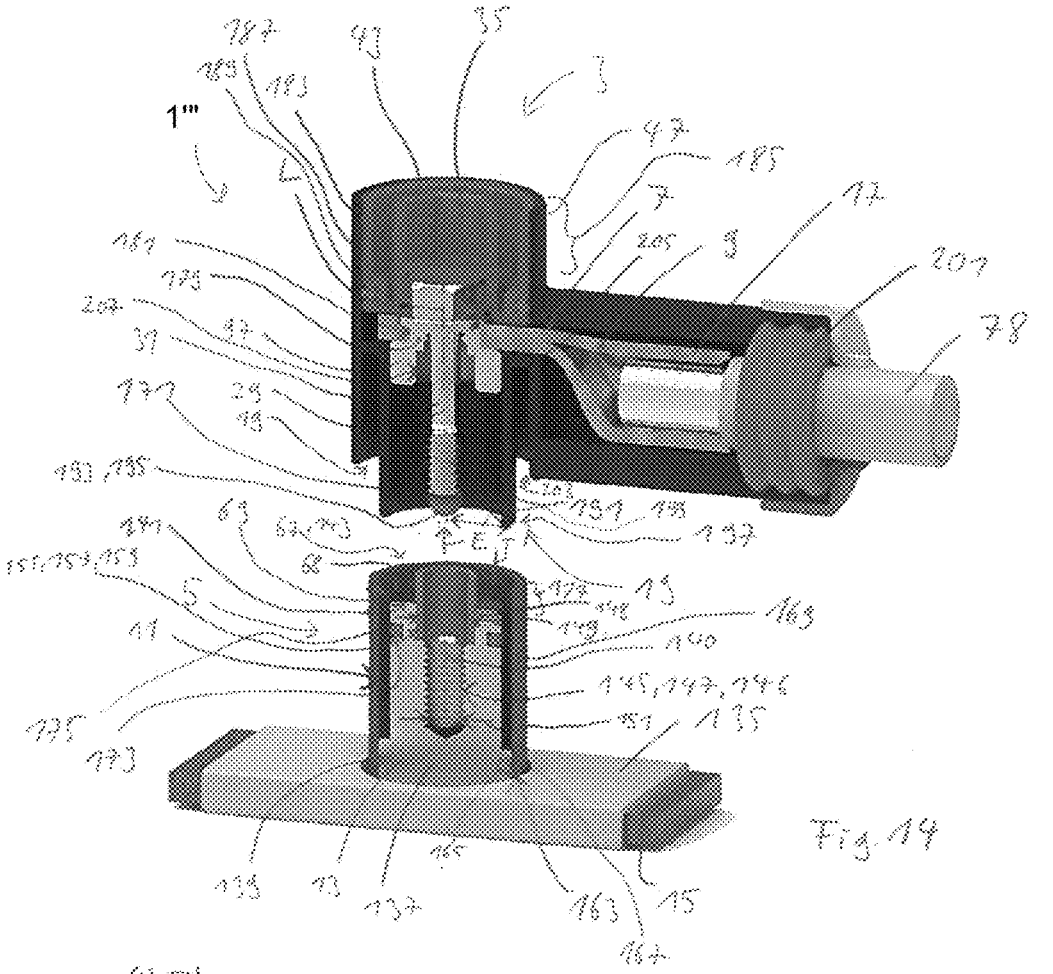
FIG. 14 is a sectional perspective view of a connector according to a fourth embodiment of the invention.
Figure 15:
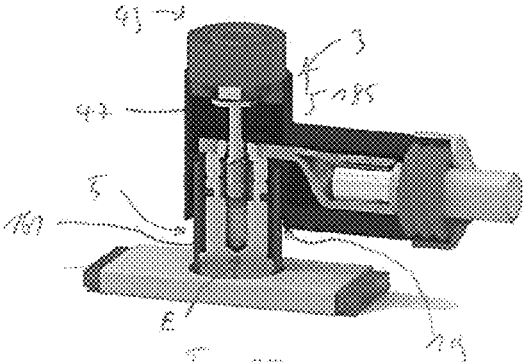
FIG. 15 is another sectional perspective view of the connector of FIG. 14.
Figure 16:
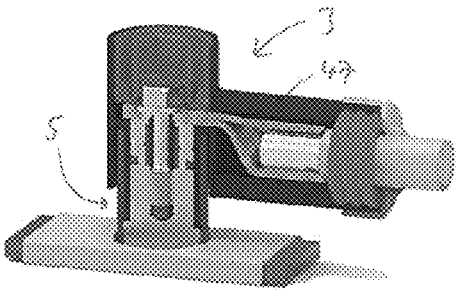
FIG. 16 is another sectional perspective view of the connector of FIG. 14.

A connector 1''' according to another embodiment of the invention is shown in FIGS. 14-16.

Connector 1''', as shown in FIG. 14, has a pressing assembly 3 with a receptacle 7 for first conductor 9 and a contact prevention member 5 with a receptacle 11 for second conductor 13. Contact prevention member 5 can be inserted into a chamber 19 of pressing assembly 3 in insertion direction E and has a contacting slot 67 which runs parallel to insertion direction E and which opens into an interior 69 of contact prevention member 5 for contacting towards the outside. Contacting slot 67 runs with its depthwise direction T parallel to insertion direction E.

The fourth embodiment is particularly advantageous if a connection is not to be made between the end portions of cables and/or conductor rails but, for example, on a part of a conductor which is not the end portion of the conductor.

Connector 1''' is used to connect a conductor rail 15 to a cable lug 17. Conductor rail 15 is surrounded at least in the region of connector 1''' by a sleeve 135, which insulates conductor rail 15 towards the outside. A connection piece 137, which is part of connector 1''', is electrically connected to conductor rail 15. Connection piece 137 extends the length of conductor rail 15 and represents second conductor 13, which is received in receptacle 11 of contact prevention member 5.

Connection piece 135 has a base 139, as shown in FIG. 14, at which it is connected to conductor rail 15. The connection between base 139 and conductor rail 15 can be performed, for example, by welding, screwing or pressing. In the case of a connection by screwing, for example, a screw extends through conductor rail 15 and is screwed into an internal thread in connection piece 137. The screw head bears against conductor rail 15 on the side thereof opposite connection piece 137.

Connection piece 137 extends along a longitudinal axis 140 parallel to insertion direction E, away from base 139, as shown in FIG. 14. Connection piece 137 has a substantially cylindrical form. Connection piece 137 is a bolt with a longitudinal axis of the bolt extending parallel to insertion direction E. End 141 of the connection piece 137 pointing away from base 139 is accessible through contacting slot 67 and can be brought into contact with contacting element 97 of first conductor 9. In this case, contacting slot 67 can be formed as an annular slot 143.

Connection piece 137, as shown in FIG. 14, has a receptacle 145 for pressing member 29. Receptacle 145 extends parallel to longitudinal axis 140 into connection piece 137. Receptacle 145 is a blind hole 146, the open end of which points in insertion direction E. Receptacle 145 is closed in the direction of base 139. Receptacle 145 is arranged centrally in connection piece 137 so that it runs coaxially to longitudinal axis 140 of connection piece 137. Alternatively, receptacle 145 can also extend continuously through connection piece 137, i.e. also through base 139 thereof, so that an opening on base 139 can be used for connecting connection piece 137 to conductor rail 15.

Receptacle 145, as shown in FIG. 14, has an internal thread 147 into which pressing member 29, in the form of a screw 31, can be screwed. If, as described above as an alternative, receptacle 145 is formed throughout and not as a blind hole, internal thread 147 can extend as far as the opening in the base so that a screw extends through conductor rail 15 and can be screwed to the internal thread in base 139. A region 148 is disposed at end 141 pointing away from base 139, in which region 148 diameter 149 of receptacle 145 is greater than diameter 151 of receptacle 145 in the region of internal thread 147. This region 148 receives sleeve 153.

Sleeve 153, as shown in FIG. 14, delimits contacting slot 67 towards receptacle 145. A longitudinal direction of sleeve 153 extends coaxially with longitudinal axis 140 of connection piece 137. Sleeve 153 is retained captively in receptacle 145. Sleeve 153 can, for example, be pressed or glued into receptacle 140. The sleeve and/or connection piece 137 has in region 148 latching means which can engage in one another in order to retain sleeve 153 in receptacle 145; connection piece 137 has in region 148 on an inner wall of receptacle 145 at least one undercut 157 into which at least one latching hook 159 of sleeve 153 can latch. Undercut 157 can be formed, for example, as a recess or as a groove running around the inner wall of receptacle 145.

On its side opposite sleeve 153, as shown in FIG. 14, contacting slot 67 is delimited by outer wall 161 of contact prevention member 5. Outer wall 161 extends cylindrically around connection piece 137 and is arranged coaxially to longitudinal axis 140 of connection piece 137. Outer wall 161 projects in the region of base 139 of connection piece 137 into recess 163 in sleeve 135 in order to ensure continuous insulation around conductor rail 15 and around connection piece 137.

In the region of base 139, as shown in FIG. 14, outer wall 161 bears directly against connection piece 137. Outer wall 161 is retained in this region on connection piece 137. For example, outer wall 161 can also be pressed onto connection piece 137. However, outer wall 161 can alternatively be latched to connection piece 137. For example, latching elements which can engage in one another can be arranged in the region of base 139 both on connection piece 137 and on outer wall 161 in order to retain outer wall 161 on connection piece 137. For example, connection piece 137 can have a recess 165 in the region of base 139 and outer wall 161 can have a latching projection 167. Recess 165 can also be formed as a circumferential groove in connection piece 135.

The connection piece 137 can also have, in the region of base 139, a circumferential groove into which a sealing element can be inserted in order to seal off the region between connection piece 137 and outer wall 161. Alternatively, a groove can also be formed in outer wall 161, or a sealing element can be arranged between outer wall 161 and connection piece 137, wherein no or both elements have a groove.

A guide slot 169 which is configured to receive a housing part 171 of pressing assembly 3 is disposed between connection piece 137 and outer wall 161, as shown in FIG. 14. Guide slot 169 extends around connection piece 137 and coaxially thereto. Guide slot 169 forms a transition into contacting slot 67 in the region of that end 141 of connection piece 137 opposite base 139. In order to obtain a seal between connection piece 137 and a housing part 171 arranged in guide slot 169, connection piece 137 has at least one groove 173 which extends around on its outer side and into which a sealing element 175, such as a seal ring, is inserted.

In the embodiment shown in FIG. 14, contacting slot 67, connection piece 137, outer wall 161 and housing part 171 are represented with a circular cross-section or with a cylindrical shape. As a result of this configuration, pressing assembly 3 can be connected to contact prevention member 5 and connection piece 137 in any desired rotational alignment about longitudinal axis 140. If, however, at least one assembly position or alignment must be defined, connector 1''' can have a protection against mismating. The connection piece 137 can have a cross-section which deviates from the circular form at at least one point. For example, connection piece 137 can be flattened on at least one side, wherein the flattened section runs parallel to longitudinal axis 140. Housing part 171 can then be shaped in a complementary manner so that it can only be connected to contact prevention member 5 in an alignment such that the complementary parts fit into one another.

Both outer wall 161 and sleeve 153 project in insertion direction E far enough beyond end 141 of connection piece 137 for an effective contact prevention member 5 to be formed to prevent contact with connection piece 137. Height 177, with which outer wall 161 projects beyond end 141, and which simultaneously represents the depth of contacting slot 67, is determined as a function of slot width 68, which is defined by the spacing between sleeve 153 and outer wall 161, and vice versa. Here, slot width 68 and height 177 are selected to be at least large enough that a finger or a VDE test finger cannot still reach end 141 of connection piece 137.

Sleeve 153 and outer wall 161 can terminate flush with one another in insertion direction E. Alternatively, outer wall 161 can protrude in insertion direction E beyond sleeve 153 in order to protect sleeve 153 from damage. In a further alternative, sleeve 153 can extend further in insertion direction E than outer wall 161 in order to enable pressing member 29 to be captured as soon as possible during the connection of two conductors to one another.

Outer wall 161 has latching elements which can be connected to latching elements, configured in a complementary manner, of housing part 171 of pressing assembly 3. As a result, housing part 171 can, in a pre-assembly position, be retained on outer wall 161, which facilitates handling of connector 1'''.

Housing part 171, as shown in FIG. 14, extends counter to the insertion direction, out of chamber 19 of pressing assembly 3. Contact prevention member 5 can be inserted into chamber 19. In an assembled state, outer wall 161 extends around housing part 171, and sleeve 153 is arranged inside housing part 171. Housing part 171 is formed substantially as a cylindrical wall and extends coaxially to longitudinal axis L of pressing adapter 29. In an assembled state, as is shown in FIGS. 15 and 16, longitudinal axis L of pressing adapter 29 and longitudinal axis 140 of connection piece 137 are identical.

Pressing assembly 3 has contacting element 97, as shown in FIG. 14, which can be connected to first conductor 9 and, in a state connected thereto, represents an elongation thereof. Contacting element 97 can be formed in an annular manner and be arranged coaxially to pressing adapter 29. Longitudinal axis L of pressing adapter 29 simultaneously forms the ring axis. Contacting element 97 can be connected fixedly to first conductor 9, represented, for example, as cable lug 17. The connection can be made, for example, by pressing, screwing or welding. In the embodiment shown in FIGS. 14-16, contacting element 97 is pressed with a connection portion 179 into a recess 181 in cable lug 17. Alternatively, contacting element 97 can also be retained movably but captively in pressing assembly 3. Housing part 171 has, for example, latching elements which are directed in the direction of pressing adapter 29 and are elastically deflectable to allow an insertion of contacting element 97 into pressing assembly 3, but effectively prevent contacting element 97 from falling out of pressing assembly 3.

Receptacle 7 for first conductor 9 or for cable lug 17, as shown in FIG. 14, extends perpendicular to longitudinal axis L so that cable lug 17 intersects longitudinal axis L of pressing adapter 29 with its end portion 87.

Pressing adapter 29 is formed as screw 31, as shown in FIG. 14, and penetrates through contacting element 97 parallel to its longitudinal axis L. Screw head 35 is arranged on a side of contacting element 97 facing away from housing part 171. Screw head 35 is connected to an electrically insulated activation portion 43 so that the screw can be activated or rotated without a tool coming into electrical con-tact with screw 31. Activation portion 43 is, on its outside 183, cylindrically shaped. Housing 47 of pressing assembly 3 is shaped, at least in a region 185 surrounding activation portion 43, as a hollow cylinder so that activation portion 43 bears with its outside 183 against housing 47. As a result, activation element 29 can be guided in pressing assembly 3 and secured against tilting transverse to housing part 171. Screw head 35 is connected fixedly to activation portion 43. This can be carried out, for example, in that the two parts are glued to one another. However, the material of activation portion 43 may be injection molded or potted around screw head 35.

Screw head 35, as shown in FIGS. 14-16, presses contacting element 97 directly against connection piece 137. Alternatively, contacting element 97 can also only be arranged on that side of cable lug 17 which is opposite screw head 35 so that screw head 35 can act upon contacting element 97 indirectly with pressure via cable lug 17. In the shown embodiment, screw head 35 is dimensioned so that it can act with pressure on both contacting element 97 directly and on a part of cable lug 17. As a result, on the one hand, a good connection can be ensured between contacting element 97 and connection piece 137, and on the other cable lug 17 can be pressed against contacting element 97, which can improve the reliability of the connection since a release of the connection between contacting element 97 and cable lug 17 is prevented.

Activation portion 43, as shown in FIG. 14, has at least one circumferential groove 187 and a sealing element 189 received in groove 187 so that a seal is formed between activation portion 43 and housing 47 in region 185. Latching elements can be mounted on outside 183 of activation portion 43 and in region 185 of housing 43, which latching elements can prevent activation portion 43 and screw 31 connected thereto from escaping.

On its side opposite head 35, as shown in FIG. 14, screw 31 has threaded portion 191 with which screw 31 can be screwed into internal thread 147 of receptacle 145. At its end 193 opposite screw head 35, screw 31 has an insulating tip 195. Insulating tip 195 is formed from an electrically non-conductive material and retained captively on screw 31. Tip 195 does not project beyond a free end 197 of housing part 171. In this manner, a contact prevention apparatus can be formed on first conductor 9 by tip 195 and by housing part 171. A spacing 199 between tip 195 and housing part 171 is selected so that a finger cannot penetrate far enough into a region between screw 31 and housing part 171 for an electrically conductive part of screw 31 to be touched. For this purpose, the fixed connection described above of screw head 35 to electrically insulated activation portion 43, and the guidance thereof in region 185 of housing 47, are advantageous since it is possible as a result of these features to prevent screw 31 being deflected or tilted in the event of pressure on screw 31 at its end 193 transverse to its longitudinal axis L so that spacing 199 between tip 195 and housing part 171 is enlarged.

Connector 1''' has a sealing element 201, as shown in FIG. 14, which encloses a cable insulation 78 of first conductor 9 and thus seals off housing 47 in the region in which conductor 9 is guided out of housing 47. Together with sealing element 189 between the electrically insulated activation portion and housing 47, housing 47 is only open towards the outside in the region of chamber 19. In this case, the electrically conducting parts such as screw 31, contacting element 97 and end portion 87 are only accessible through a region surrounded by housing part 171.

Housing 47 has a receiving slot 203 extending around housing part 171 for receiving outer wall 161 of contact prevention member 5, as shown in FIG. 14, but base 205 of receiving slot 203 is closed so that the electrically conducting parts of pressing assembly 3 are not accessible from receiving slot 203. If contact prevention member 5 is received with connection piece 137 in chamber 19, the interior of pressing assembly 3 or the electrically conducting elements arranged in pressing assembly 3 can be sealed towards the outside.

The assembly of pressing assembly 3 with contact prevention member 5 and the connection of both conductors 9 and 13 are described below with reference to FIGS. 15 and 16. For the sake of clarity, only the reference numerals which are absolutely essential for understanding are included in FIGS. 15 and 16.

Contact prevention member 5 is initially inserted into chamber 19 in insertion direction E. Outer wall 161 penetrates into receiving slot 203, housing part 171 into guide slot 169 and screw 31 into receptacle 145. Contacting element 97 penetrates through contacting slot 67 and bears against end 141 of connection piece 137. Sleeve 153 penetrates with its free end into a receiving region 207 of contacting element 97. Receiving region 207 is disposed between screw 31 and the rest of contacting element 97. Screw 31 is initially received with its threaded portion 191 in sleeve 153. As contact prevention member 5 is inserted into chamber 19, screw 31 is displaced in insertion direction E so that electrically insulated activation portion 43 protrudes out of region 185 of housing 47. For final connection, pressing member 29 is activated in that screw 31 is screwed into receptacle 145. A tool formed in a complementary manner to electrically insulated activation portion 43 can be used for this purpose.

In a connected state, as shown in FIG. 16, electrically insulated activation portion 43 is countersunk in housing 47. Contacting element 97 is pressed by pressing member 29 against connection piece 137. As a result, an electrically conducting connection is established between first conductor 9 and second conductor 13. The electrically conducting parts of connector 1, in particular connection piece 137, screw 31, contacting element 97 and cable lug 17 are sealed off to the outside by sealing elements 175, 189 and 201 and by the connection between outer wall 161 and base 139.

Advantageously, in the connector 1, 1', 1", 1'" of the present invention, the contact prevention member 5 effectively prevents a person or another part unintentionally touching the second conductor 13 received in the contact prevention member 5. The first and the second conductor 9, 13 can be pressed against one another in the pressing adapter 3 by the pressing member 29 which can be activated from the outside so that an electrical connection can be established between the two conductors 9, 13. A direct screwing of the two conductors 9, 13 to one another can thus be omitted, which is why the two conductors 9, 13 can be repeatedly smoothly connected to one another or detached from one another.

What is claimed is:

1. A connector, comprising:

a pressing assembly having a first receptacle receiving a first conductor, a pressing member which can be activated from an exterior of the pressing assembly, and a chamber; and a contact prevention member having a contacting slot open to an interior of the contact prevention member and a second receptacle receiving a second conductor, the contact prevention member insertable into the chamber of the pressing assembly in an insertion direction, the second conductor exposed to the chamber through the contacting slot.

2. The connector of claim 1, wherein the contact slot extends parallel to the insertion direction.

3. The connector of claim 1, wherein the pressing member is retained on the pressing assembly.

4. The connector of claim 1, further comprising a movable force-distribution member on which the pressing member acts.

5. The connector of claim 4, wherein the force-distribution member is retained on the pressing member.

6. The connector of claim 4, wherein the force-distribution member is retained on the pressing assembly.

7. The connector of claim 1, wherein the pressing member has an activation portion electrically insulated from a remainder of the pressing member.

8. The connector of claim 7, further comprising a housing electrically insulated from the pressing assembly.

9. The connector of claim 8, wherein the activation portion of the pressing member is accessible from an exterior of the housing.

10. The connector of claim 1, wherein the contact prevention member is closed at a front end extending in the insertion direction.

11. The connector of claim 1, wherein the first conductor is a conductor rail at least in an end portion of the first conductor disposed in the first receptacle, and the second conductor is a cable lug at least in an end portion of the second conductor disposed in the second receptacle.

12. The connector of claim 1, wherein, when the contact prevention member is inserted into the chamber of the pressing assembly, a contacting element of the first conductor frictionally engages the second conductor under a pressing force imparted by the pressing member.

13. The connector of claim 12, wherein the contacting element of the first conductor is disposed in the contacting slot of the contact prevention member.

14. The connector of claim 13, wherein an end portion of the first conductor has a U-shaped profile with a pair of limbs, the pair of limbs pressed by the pressing member through a pair of contacting slots of the contact prevention member and into contact with the second conductor.

15. The connector of claim 1, wherein an electrically conductive connection piece is fastened to the second conductor, the connection piece surrounded by an outer wall of the contact prevention member.

16. The connector of claim 15, wherein the connection piece receives the pressing member in a third receptacle of the connection piece in the insertion direction, the contacting slot extending around the third receptacle.

17. The connector of claim 16, wherein the contacting slot is delimited from the third receptacle by a sleeve inserted into the connection piece, the pressing member penetrating the sleeve in the insertion direction.

18. The connector of claim 16, wherein a guide slot extends concentrically around the connection piece and receives a housing part of the pressing assembly, the housing part disposed between the connection piece and the outer wall of the contact prevention member.

19. The connector of claim 16, wherein a contacting element is connected to the first conductor and is complementary to the contacting slot, the contacting element pressed by the pressing member through the contacting slot and against the connection piece.

20. The connector of claim 19, wherein the contacting element is sleeve-shaped and is penetrated by the pressing member in the insertion direction.

* * * * *